US005908003A

United States Patent [19]

Hura et al.

[11] Patent Number: 5,908,003

[45] Date of Patent: Jun. 1, 1999

[54] NITROGEN OXIDE REDUCTION BY GASEOUS FUEL INJECTION IN LOW TEMPERATURE, OVERALL FUEL-LEAN FLUE GAS

[75] Inventors: Harjit S. Hura, Cincinnati, Ohio; Bernard P. Breen, Pittsburgh, Pa.

[73] Assignee: Gas Research Institute, Chicago, Ill.

[21] Appl. No.: 08/908,824

[22] Filed: Aug. 8, 1997

Related U.S. Application Data

[60] Provisional application No. 60/023,667, Aug. 15, 1996.

[51] Int. Cl.[6] ..... F23J 11/00; F23D 1/00; F23L 1/00; F23B 5/00

[52] U.S. Cl. ..... 110/345; 110/210; 110/212; 110/214; 110/262; 110/263; 110/344; 110/345; 110/347; 110/348; 431/2; 431/5

[58] Field of Search ..... 110/210, 212, 110/214, 260, 261, 262, 263, 265, 343, 344, 345, 347, 348; 431/2, 4, 5, 8, 9, 10

[56] References Cited

U.S. PATENT DOCUMENTS

| | | | |
|---|---|---|---|
| 3,867,507 | 2/1975 | Myerson | 423/212 |
| 4,427,362 | 1/1984 | Dykema | 431/10 X |
| 4,768,446 | 9/1988 | Wilkes et al. | 110/262 |
| 5,020,456 | 6/1991 | Khinkis et al. | 110/345 |
| 5,078,064 | 1/1992 | Breen et al. | 110/212 |
| 5,105,747 | 4/1992 | Khinkis et al. | 110/345 |
| 5,131,335 | 7/1992 | Spliethoff et al. | 110/214 X |
| 5,190,451 | 3/1993 | Goldbach | 110/212 |
| 5,205,227 | 4/1993 | Khinkis et al. | 110/345 |
| 5,213,492 | 5/1993 | Ho | 431/10 |
| 5,269,235 | 12/1993 | McGill et al. | 110/212 X |
| 5,307,746 | 5/1994 | Khinkis et al. | 110/245 |
| 5,636,977 | 6/1997 | Benson et al. | 431/8 |

OTHER PUBLICATIONS

J.C. Opatrny, C.C. Hong, T.M. Sommer, B.A. Folsom, R. Payne, E.G. Rindahl, J.M. Pratapas: *Second–Generation Gas Reburning Technology*, Paper presented at the 1994 ASME International Joint Power Generation Conference, Oct. 2–6, 1994, Phoenix, Arizona.

*Primary Examiner*—Ira S. Lazarus
*Assistant Examiner*—Ljiljana V. Ciric
*Attorney, Agent, or Firm*—Pauley Petersen Kinne & Fejer

[57] ABSTRACT

A process and apparatus for combustion of a solid carbonaceous material, for example coal, in which a mixture of the solid carbonaceous material and combustion air is injected into a combustion chamber and ignited, thereby forming a fuel-lean primary combustion zone. A gaseous fuel is injected into the combustion chamber in a region downstream of the primary combustion zone, thereby forming a fuel-lean secondary combustion zone. Temperature in the secondary combustion zone is in the range of about 1800° F. to 2400° F.

15 Claims, 4 Drawing Sheets

NITROGEN OXIDE REDUCTION BY GASEOUS FUEL INJECTION IN LOW TEMPERATURE, OVERALL FUEL-LEAN FLUE GAS

CROSS REFERENCE TO RELATED APPLICATION

This application claims the benefit of U.S. Provisional Application No. 60/023,667, filed Aug. 15, 1996.

BACKGROUND OF THE INVENTION

1. Field of the Invention

This invention relates to a fuel reburn process and apparatus for reduction of $NO_x$ emissions resulting from the combustion of solid carbonaceous materials, such as coal, in boilers, fluidized bed combustors, and similar combustion devices. In addition to reducing $NO_x$ emissions from boilers and similar devices, the fuel reburn process and apparatus of this invention also maintain CO emissions at environmentally acceptable levels without the addition of air or oxygen downstream of the fuel reburn zone.

2. Description of Prior Art

The utilization of coal for power generation results in emission of nitric oxides ($NO_x$) which are formed primarily as a result of oxidation of the nitrogen inherent in the coal and oxidation of molecular nitrogen present in the combustion air. Nitric oxides released in the atmosphere contribute to acid rain, accelerate the photochemical reactions responsible for smog, and result in increased ground level ozone concentrations. The emission of nitric oxides from existing coal burning power plants is governed by Title I and Title IV of the Clean Air Act Amendments of 1990. Title IV limits the allowable $NO_x$ emissions to 0.45 pounds per MBtu for tangential fired boilers and 0.50 pounds per MBtu (approximately 375 ppm) for wall fired boilers. $NO_x$ emission limits at 0.20 pounds per MBtu have been proposed in the ozone non-attainment areas under Title I, and have been targeted for decade end implementation under the Ozone Transport Region Memorandum of Understanding.

One technique for reducing the amount of $NO_x$ produced in a combustion process and, thus, emitted by said combustion process, is the use of fuel-rich reburn. Such a reburn process is taught, for example, by U.S. Pat. No. 5,020,456; U.S. Pat. No. 5,105,747; U.S. Pat. No. 5,307,746; and U.S. Pat. No. 5,205,227. Each of these U.S. patents teaches a process and apparatus for emissions reduction from waste incineration in which a combustible material is burned in a primary combustion zone in the lower region of a combustion chamber, and an oxygen deficient secondary combustion zone for mixing with the combustion products from the primary combustion zone is formed by the injection of fuel, a calcined sorbent, recirculated flue gases, and, in some instances, a carrier fluid injected into the combustion chamber above the primary combustion zone. In each case, however, overfire air is injected into the combustion chamber above the oxygen deficient secondary combustion zone to ensure complete combustion of any remaining combustible materials in the combustion products from the oxygen deficient secondary combustion zone. The use of overfire air is necessary to ensure that no unburned hydrocarbons are exhausted by the combustion process. The requirement for overfire air adds significant capital and operating costs.

SUMMARY OF THE INVENTION

Accordingly, it is one object of this invention to provide a process for combustion of a solid carbonaceous material, such as coal, which reduces the amount of $NO_x$ emissions generated and emitted compared to conventional coal combustion processes.

It is another object of this invention to provide a process and apparatus for combustion of a solid carbonaceous material which reduces $NO_x$ emissions in the range of 20–60% over conventional uncontrolled combustion processes.

It is yet another object of this invention to provide a process for combustion of a solid carbonaceous material by employing a fuel reburn process which maintains CO at environmentally acceptable levels but does not require the use of overfire air injection, thereby reducing both the capital and operating costs as compared to combustion processes utilizing conventional reburn technology.

It is yet another object of this invention to provide a process and apparatus for combustion of a solid carbonaceous material which does not give rise to slagging and fouling problems like other low $NO_x$ technologies.

These and other objects of this invention are achieved by a process for combustion of a solid carbonaceous material, such as pulverized or crushed coal, comprising injecting a mixture of the solid carbonaceous material and combustion air into a combustion chamber and igniting the mixture, thereby forming a fuel-lean primary combustion zone, and injecting a gaseous fuel into the combustion chamber in a region above, or downstream of, the primary combustion zone, thereby forming a fuel-lean secondary combustion zone. The secondary combustion zone has a temperature in the range of about 1800° F. to about 2400° F. The conditions in this secondary combustion zone are not favorable for producing CO and, thus, CO is not produced in amounts sufficient to require the injection of air or oxygen downstream of the second combustion zone in order to maintain CO emissions at acceptable levels.

In accordance with a particularly preferred embodiment of the process of this invention, the gaseous fuel injected into the combustion chamber to form the fuel-lean secondary combustion zone is natural gas. In accordance with another embodiment of this invention, the gaseous fuel is injected into the combustion chamber together with a carrier fluid.

The apparatus for combustion of a solid carbonaceous material in accordance with one embodiment of this invention comprises at least one combustion chamber wall enclosing a combustion chamber, the combustion chamber having an upstream portion and a downstream portion, fuel injection means for injecting the pulverized solid carbonaceous material into the upstream portion of the combustion chamber, gaseous fuel injection means for injecting a gaseous fuel into the downstream portion of the combustion chamber, and feedback means for maintaining an oxygen content in the flue gases exhausted from the combustion chamber in a range of about 1.0% to 2.0%. In accordance with one embodiment of the apparatus of this invention, the gaseous fuel injection means comprises a carrier fluid injection means for injecting a carrier fluid together with the gaseous fuel into the combustion chamber.

BRIEF DESCRIPTION OF THE DRAWINGS

These and other objects and features of this invention will be better understood from the following detailed description taken in conjunction with the drawings wherein:

DESCRIPTION OF PREFERRED EMBODIMENTS $NO_x$ emissions from boilers are a result of chemical kinetic and not thermodynamic limitations. FIG. 5 shows the equilibrium NO concentrations in typical flue gases from a boiler as a function of temperature and oxygen content. The equilibrium NO concentration decreases rapidly with decreasing flue gas temperature, and concentrations of NO under 100 ppm are predicted at flue gas temperatures of 1800° F. Therefore, NO emissions from boilers are a result of quenching of the NO equilibrating chemistry. Conventional in-furnace and back-end $NO_x$ control technologies remove the chemical kinetic constraints to NO equilibration by injecting small amounts of natural gas and amine ($NH_i$) based compounds, such as ammonia and urea, into the combustion chamber.

A conventional fuel reburning process for a coal-fired boiler is shown in FIG. 1. Coal is introduced through fuel injection means 13 into a lower, or upstream, region of combustion chamber 16 forming primary combustion zone, as indicated by arrows 10, having a stoichiometry of air/fuel of about 1.1. Air and natural gas, the natural gas comprising about 20% of the total heat input to the combustion chamber 16 are introduced through gaseous fuel injection means 14 into an upper, or downstream, region of combustion chamber 16, creating a secondary combustion zone, as indicated by arrows 11, above, or downstream of, the primary combustion zone 10, the secondary combustion zone being oxygen deficient, that is, having a zone stoichiometry of about 0.9. As a result, conventional reburn processes require the addition of overfire air through overfire air injection means 26 to create a tertiary combustion zone 25 above, or downstream of, the secondary combustion zone 11 to ensure complete combustion of any combustibles in the combustion products from the secondary combustion zone 11. As shown in FIG. 1, the stoichiometry of the tertiary combustion zone 25 is fuel-lean, typically about 1.16. As compared to the process and apparatus of this invention, the conventional reburn process requires greater quantities of gas and the use of overfire air, both of which increase the costs associated with $NO_x$ control.

Figure 4:
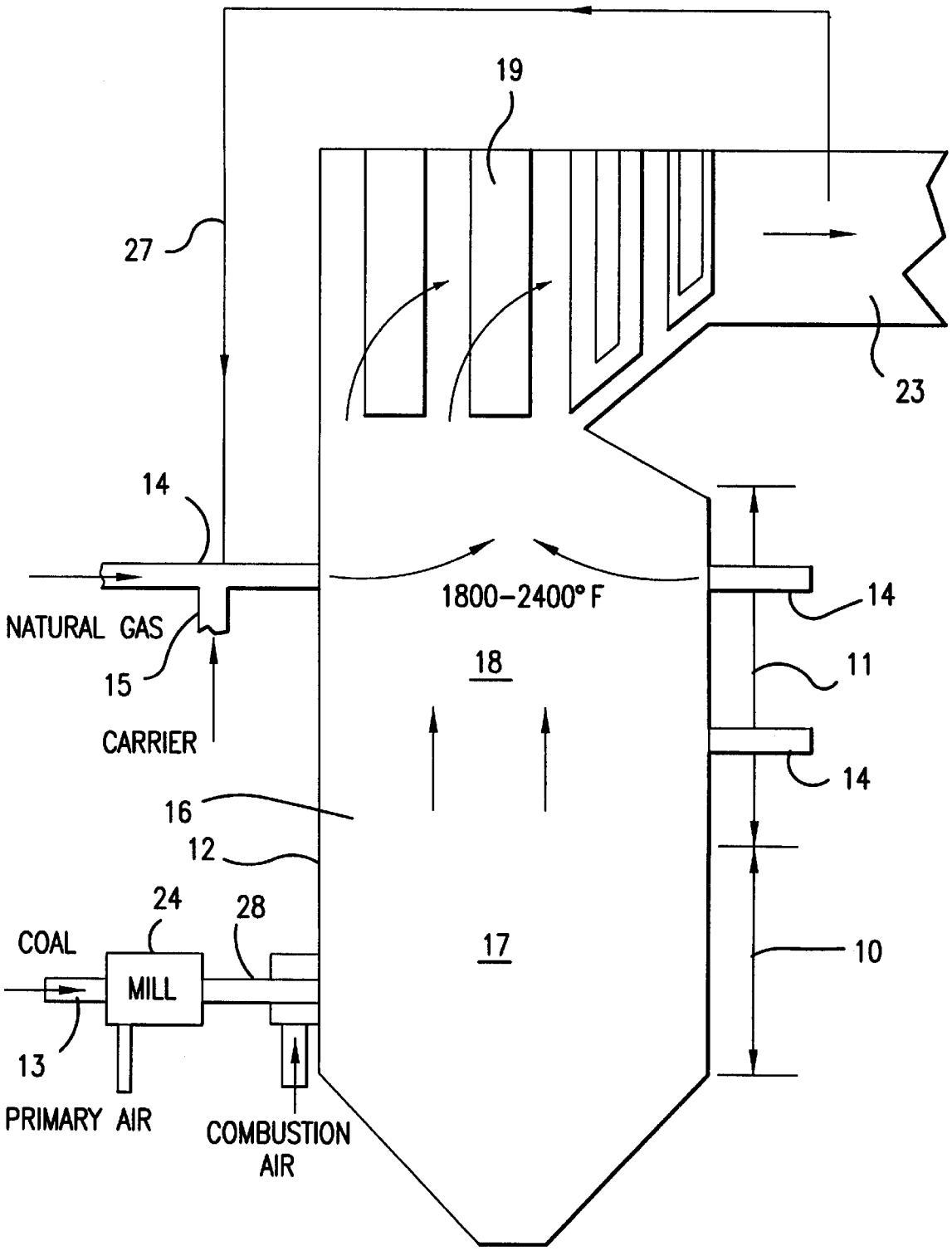
FIG. 4 is a schematic diagram of a combustion apparatus utilizing the fuel reburn process of this invention.
Figure 5:
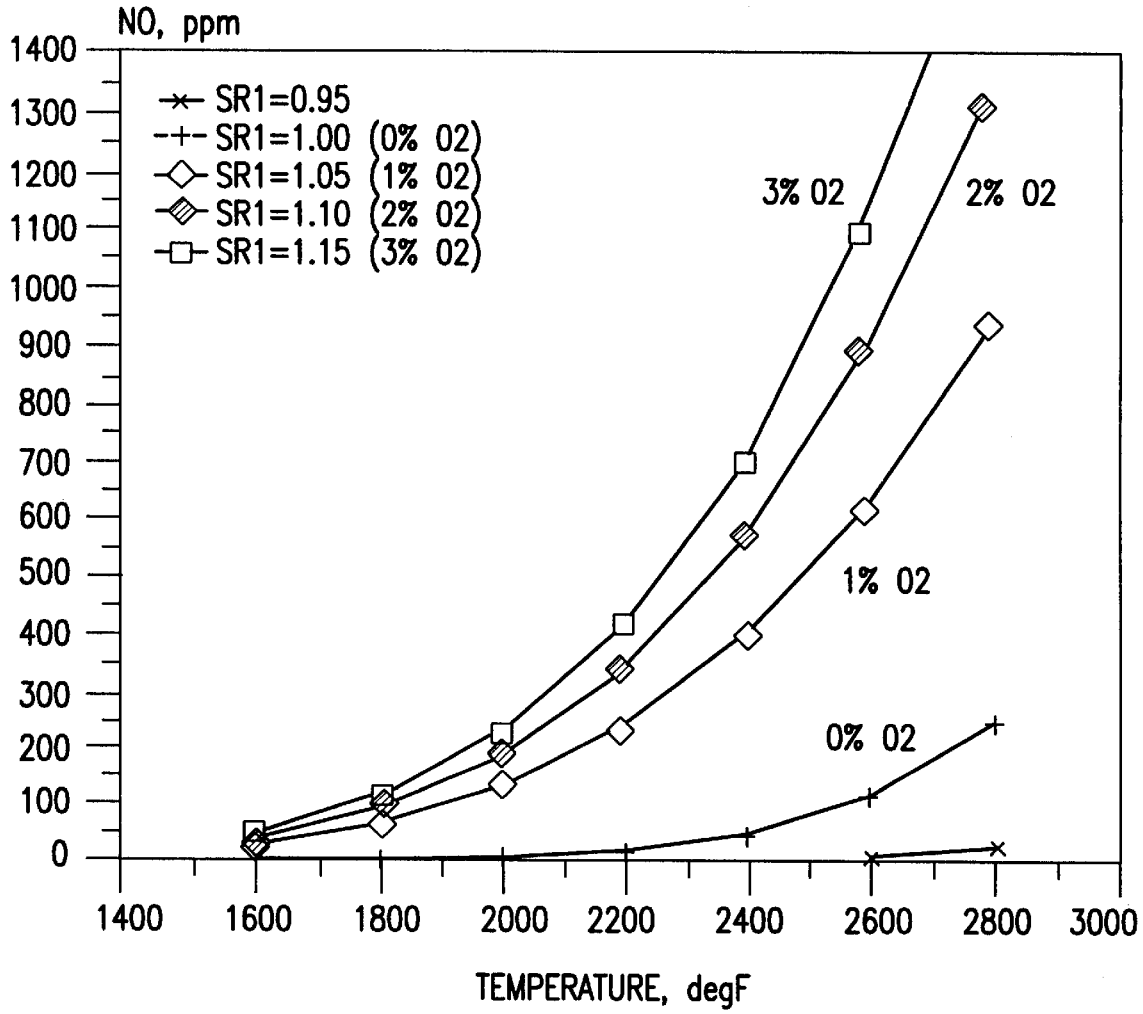
FIG. 5 is a diagram showing equilibrium NO concentrations in typical flue gases as a function of temperature and oxygen content.

The process for combustion of a solid carbonaceous material in accordance with one embodiment of this invention comprises injecting a mixture of solid carbonaceous material, preferably coal, and combustion air into a combustion chamber and igniting the mixture, thereby forming a fuel-lean primary combustion zone 10 as shown in FIG. 4. The stoichiometric ratio in the primary combustion zone 10 is preferably in the range of about 1.05–1.30. A gaseous fuel is injected into the combustion chamber in a region above, or downstream of, the primary combustion zone 10, forming a fuel-lean secondary combustion zone 11. The stoichiometric ratio in the fuel-lean secondary combustion zone 11 is preferably in the range of about 1.05–1.15. To inhibit the formation of $NO_x$ in the secondary combustion zone, the secondary combustion zone 11 has a temperature in the range of about 1800° F. to 2400° F. In accordance with a particularly preferred embodiment of this invention, the gaseous fuel injected into the combustion chamber above, or downstream of, the primary combustion zone 10 is natural gas in an amount comprising in the range of about 2% to 15% of the total amount of heat input to the combustion chamber. Although the description of this invention is geared toward a solid fuel combustor in which the solid fuel is introduced into a lower region of the combustion chamber and reburn fuel is introduced into a region of the combustion chamber "above" the lower region, there is no intent to limit the scope of this invention to combustors of this configuration. The critical feature of this invention is the introduction of a reburn fuel downstream of a primary combustion zone formed by combustion of the solid carbonaceous fuel so as to form a fuel-lean secondary combustion zone downstream of the primary combustion zone, reducing $NO_x$ by 20–60% over conventional combustion processes, all the while maintaining CO at environmentally acceptable levels, without utilizing additional combustion air downstream of the secondary combustion zone.

By the term "solid carbonaceous material" as used throughout this description and the claims, we mean any solid material having sufficient carbon content to render said material suitable for use as a fuel. The material may be pretreated, for example, crushed or pulverized, to render said material suitable for mixing with combustion air and introduction into a combustion chamber.

The process of this invention relies on achieving high $NO_x$ reductions with acceptable CO levels by injecting the gaseous fuel, such as natural gas, into the products of combustion generated in primary combustion zone 10 in a temperature window of about 1800°–2400° F. Given the conditions of typical products of combustion, $NO_x$ reductions of 20% to 60% can be expected at a natural gas input of 2% to 15% of the total heat input to the furnace. No overfire air injection is needed because fuel-lean conditions are maintained in both the primary and secondary combustion zones 10, 11.

In addition, because gaseous fuels burn more rapidly at a lower temperature than solid carbonaceous fuels such as coal, the gaseous fuel can be introduced at a higher elevation, or further downstream, and a lower temperature within the combustion chamber than the coal. This lower temperature acts to reduce the equilibrium level of nitrogen oxide in the products of combustion and, thus, increases the nitrogen oxide reduction possible. The cost of reducing $NO_x$ is decreased because duct work is not necessary for injection of completion air, and less natural gas is used than in the conventional fuel-rich reburn process. Thus, both capital and operating costs are lower than in conventional reburn processes.

The process of this invention reduces nitrogen oxide emissions in several ways. First, the gaseous fuel, natural gas or other preferred hydrocarbon, has no fixed nitrogen. Consequently, no nitrogen oxides are produced from the fuel source. In fact, the nitrogen oxide emissions per Btu of fuel fired is decreased due to displacement of the solid carbonaceous fuel by the gaseous fuel. Secondly, the gas is injected at temperatures below 3000° F., as a result of which thermal nitrogen oxide formation is negligible. Thirdly, the gaseous fuel reduces the $NO_x$ in the flue gases due to the following reactions.

Nitric oxide reduction during conventional reburning occurs through its reactions with $CH_i$ and $NH_i$ radicals. The partial oxidation and pyrolysis of the hydrocarbon fuel results in the formation of $CH_i$ radicals which react with NO to form HCN. This initial chemistry is followed by radical abstraction reactions of HCN which results in $N_2$, $NH_3$, and/or $NO_x$ formation, and further $NO_x$ reduction from the amine radicals. The low temperature gas combustion significantly improves the overall $NO_x$ reduction due to the selective chemistry between the NO and the $NH_i$ radicals in a narrow temperature window around 1800° F. In conventional reburn, due to high completion temperatures, a substantial portion of the HCN and $NH_3$ formed in the fuel-rich reburn zone is reconverted into $NO_x$ during completion air addition.

FIG. 4 shows a schematic diagram of an improved apparatus for reducing nitrogen oxide emissions in combustion products from combustion of a pulverized solid carbonaceous material in accordance with one embodiment of this invention. The apparatus comprises at least one combustion chamber wall 12 enclosing combustion chamber 16, combustion chamber 16 having a lower portion 17 and an upper portion 18. The apparatus further comprises fuel injection means 13 for injecting the pulverized solid carbonaceous material into lower portion 17 of combustion chamber 16 to form a primary combustion zone as designated by arrows 10. Gaseous fuel injection means 14 are provided for injecting a gaseous fuel into upper portion 18 of combustion chamber 16, thereby forming a secondary combustion zone designated by arrows 11 in upper portion 18 of combustion chamber 16 above primary combustion zone 10. As shown, gaseous fuel injection means 14 may be provided at multiple levels of combustion chamber 16 thereby providing multiple layers of injected fuel in upper portion 18 of combustion chamber 16. Feedback means 27 measure the oxygen content in the flue gases exhausted through furnace exhaust 23 and, in accordance with one embodiment of this invention, provide a signal for controlling the amount of gaseous fuel injected into combustion chamber 16 so as to maintain an oxygen content in the flue gases in the range of about 0.5% to 5.0% and most preferably in the range of about 1.0% to 2.0% while maintaining CO at acceptable levels, nominally less than about 200 ppm.

In accordance with one preferred embodiment of this invention, fuel injection means 14 comprises carrier fluid injection means 15 for injecting a carrier fluid together with the gaseous fuel into combustion chamber 16. In accordance with a typical operation of the process of this invention, the carrier fluid flow through carrier fluid injection means 15 is set after which the gaseous fuel flow is gradually increased to achieve a target stoichiometry in upper portion 18 of combustion chamber 16. The preferred stoichiometry in secondary combustion zone 11 is in the range of about 1.05 to 1.20 and the most preferred stoichiometry is in the range of about 1.05 to 1.10 which corresponds to a final flue gas oxygen content of about 1.0% to 2.0%. By way of example, if primary combustion zone 10 has a stoichiometry of 1.15 corresponding to approximately 3% primary combustion zone oxygen content, injection of natural gas in the amount of 7.5% of the total heat input to the combustion chamber 16 will result in a final stoichiometry of about 1.075, or 1.5% flue gas oxygen content. Gaseous fuel injection means 14 controls the gaseous fuel flow into combustion chamber 16 to maintain the target stoichiometry using oxygen concentration in the flue gas as an input as provided by feedback means 27. Gaseous fuel flow can be expected to vary continuously due to the dynamic nature of the boiler flow field. For example, in a coal-fired boiler, it is not unusual for oxygen content in the combustion gas entering the secondary combustion zone to vary by plus or minus 0.25% about a mean value over a several minute period. The variation is a result of the uncontrolled variation in coal feed rate, the time lags associated with adjustments in the air fans and inaccuracies or inadequacies in the measured data and control systems. Therefore, it is expected that secondary combustion zone stoichiometry, although always remaining fuel-lean, will vary about the preferred stoichiometry to some extent.

In accordance with a particularly preferred embodiment of this invention, combustion chamber 16 is designed to utilize coal. The coal enters combustion chamber 16 through fuel injection means 13 comprising mill 24 and nozzle 28. The fuel burns in primary combustion zone 10 in which temperatures are typically in excess of about 3000° F. The combustion products from combustion chamber 16, pass heat exchangers 19 and through furnace exhaust 23. The flue gas preferably has a temperature in the range of about 1800°–2500° F. when it exits through furnace exhaust 23 near heat exchangers 19. Heat exchangers 19 cause the temperature to drop very rapidly and any unburned fuel which enters these heat exchangers usually will be wasted and exit the combustion chamber as hydrocarbon emissions.

During the combustion of the solid fuel, some of the fuel bound nitrogen will react with oxygen to form $NO_x$ and some $NO_x$ will be formed from atmospheric nitrogen and oxygen. The process of this invention reduces $NO_x$ by injecting gaseous fuel into combustion chamber 16 between lower portion 17 and heat exchangers 19.

Figure 1:
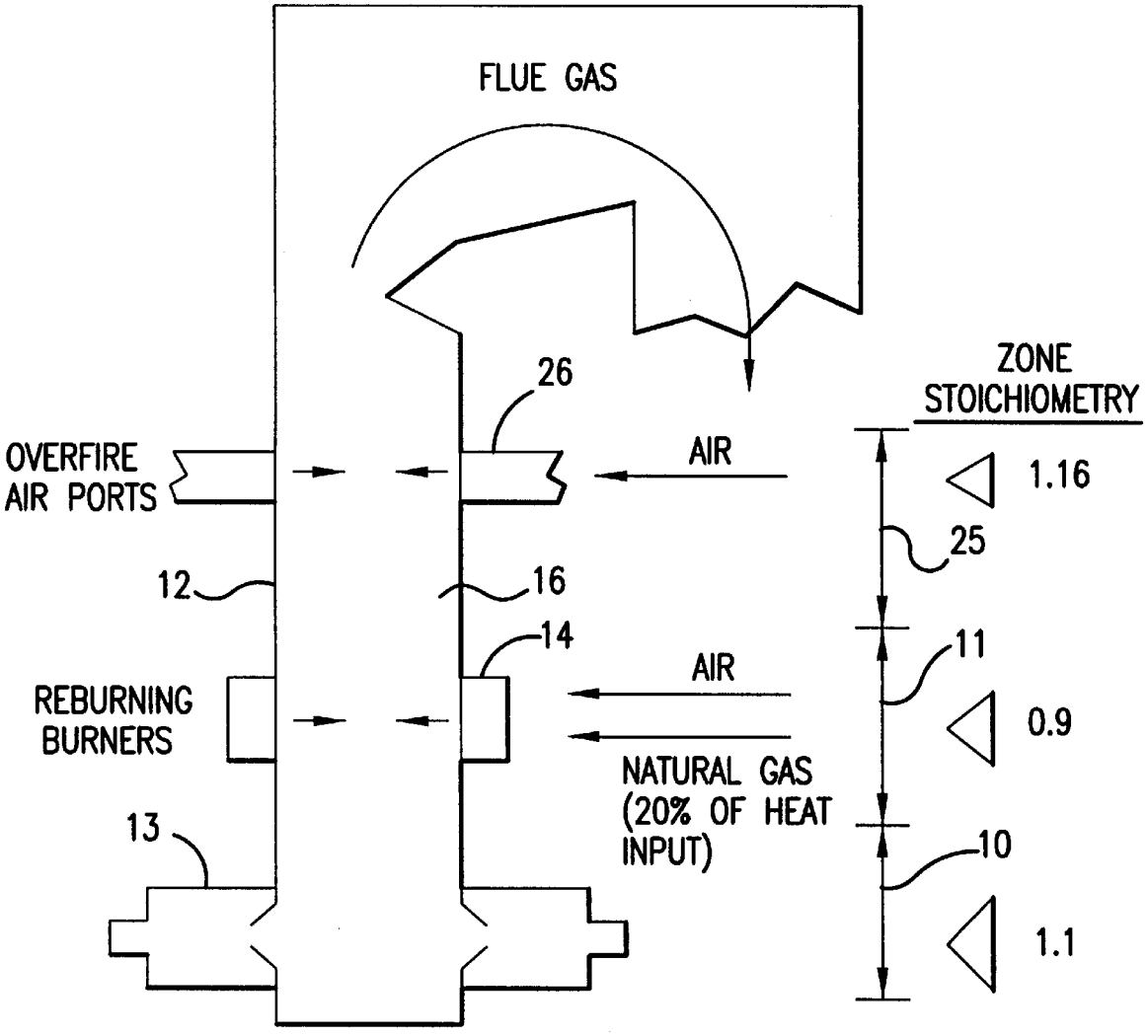
FIG. 1 (PRIOR ART)
FIG. 1 is a schematic diagram of a conventional combustion apparatus utilizing reburn as a means for controlling $NO_x$ emissions.
Figure 2:
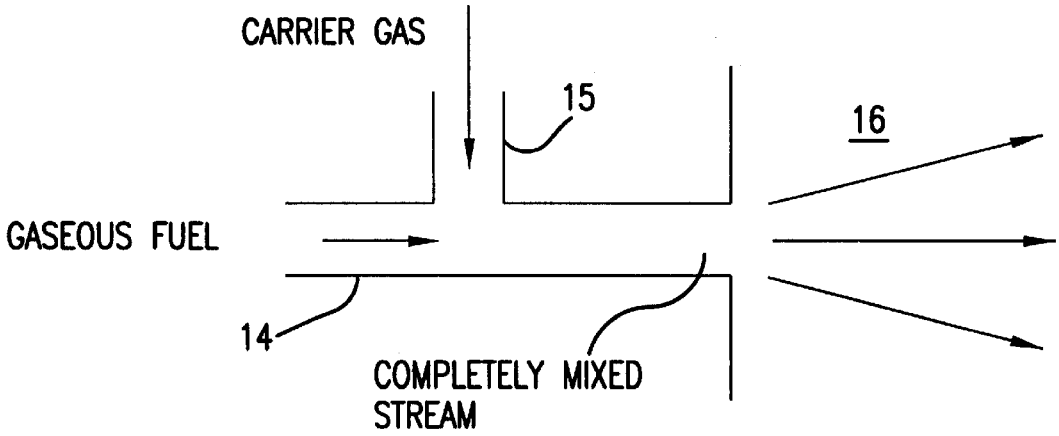
FIG. 2 is a schematic diagram of one gaseous fuel injector for a combustion apparatus in accordance with one embodiment of this invention.
Figure 3:
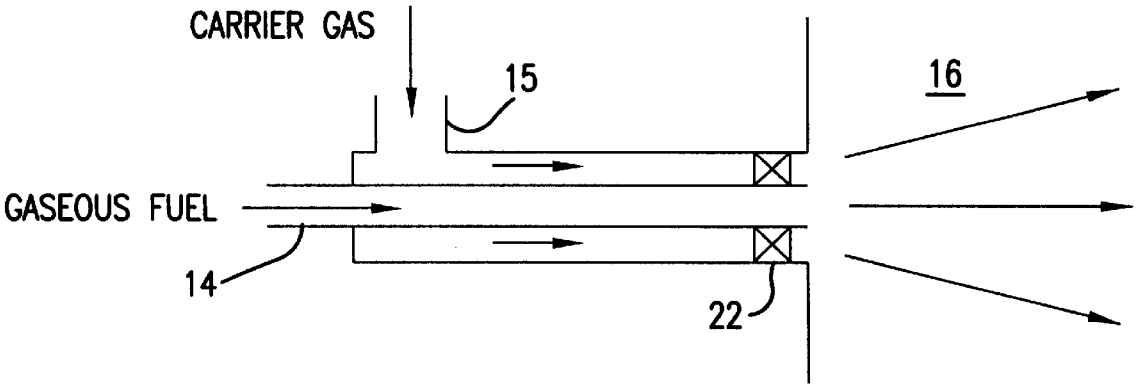
FIG. 3 is a schematic diagram of a gaseous fuel injector for a combustion apparatus in accordance with another embodiment of this invention.

In accordance with one preferred embodiment of this invention, the combustion apparatus comprises carrier fluid injector means 15 for injecting a carrier fluid with the gaseous fuel into the upper portion 18 of combustion chamber 16. Carrier fluid flow is controlled to achieve rapid and uniformal dispersal of the gaseous fuel in the combustion chamber. Said fuel injection means 13 in accordance with one embodiment are injectors designed to inject the fuel/carrier gas mixture as high velocity, high momentum fuel-rich turbulent jets. The injectors themselves can be of an internal mixing variety as shown in FIG. 2 or an external mixing variety as shown in FIG. 3. The high velocity jets typically require gas supply pressures greater than about 5 psig. The jets mix and entrain the $NO_x$ containing flue gases to create fuel-rich eddies where the NO is reduced to $N_2$.

As shown in FIG. 2, a gas injector in accordance with one embodiment of this invention utilizes internal mixing in which the gaseous fuel and carrier fluid are mixed prior to introduction into the combustion chamber. In the external mixing design, shown in FIG. 3, there is no mixing of the gaseous fuel and carrier fluid inside the injector. In both injector designs, a nozzle is mounted at the injector tip to control the jet velocity and jet size. The jet velocity and jet diameter determine the penetration and mixture characteristics of the gaseous fuel/carrier fluid jets. In accordance with one preferred embodiment of this invention, the external mixing injector comprises swirlers 22 for swirling the carrier fluid as it exits, thereby promoting mixing with the gaseous fuel in the combustion chamber.

EXAMPLE

Lance injectors, were utilized during a series of tests of the process and apparatus of this invention. The tests were conducted on a single cyclone-fired 6 MBtu/hour test facility. The cyclone was typically operated with an excess oxygen of 2% to 4% and the initial $NO_x$ was in the 800 ppm to 1200 ppm range. $NO_x$ reductions of 40% were achieved with 5% to 7% gaseous fuel injection in 2200° F. to 2300° F. flue gas. Higher $NO_x$ reductions were achieved when the gaseous fuel was injected at lower temperatures. A maximum reduction of 58% was measured for 11% gaseous fuel injection in 4.1% oxygen furnace gas at an injection temperature of 2000° F. The gas used was natural gas. These results demonstrate that natural gas can be ignited and its combustion completed in low oxygen and low temperature flue gas, thus allowing nitric oxide to equilibrate towards levels commensurate with the lower oxygen and lower temperature furnace exit conditions.

These tests also show that uniform mixing or dispersion of the injected gaseous fuel with the nitric oxide containing flue gas is important for achieving simultaneous nitric oxide and carbon monoxide emissions control. Given the small injection volume (less than about 1.0%) of the gaseous fuel, use of a carrier to improve mixing may be necessary in some applications. In general, large units (greater than 200 MW) and un its which require gas fuel jet penetrations greater than approximately 10 feet will likely require a carrier fluid to deliver the gas into the furnace. The use of a carrier would also be beneficial in furnaces which have a very non-uniform flow entering the gas injection zone. In accordance with one preferred embodiment of this invention, the mass flow rate of carrier fluid injected into the combustion chamber is up to about five times the mass flow rate of gaseous fuel injected into the combustion chamber. In accordance with a particularly preferred embodiment, the mass flow rate of carrier fluid injected into the combustion chamber is in the range of about 1 to 2 times the mass flow rate of gaseous fuel injected into the combustion chamber. The carrier fluid should preferably be an inert gas. Preferred carrier fluids are steam and recirculated flue gas, although air can also be used.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A two-stage process for combustion of a solid carbonaceous material comprising:

injecting a mixture of said solid carbonaceous material and combustion air into a combustion chamber and igniting said mixture, thereby forming a fuel-lean primary combustion zone; and injecting a gaseous fuel into said combustion chamber in a region downstream of said primary combustion zone, thereby forming a fuel-lean secondary combustion zone, said secondary combustion zone having a temperature in a range of about 1800° F. to 2400° F.

2. A process in accordance with claim 1, wherein said gaseous fuel is natural gas.

3. A process in accordance with claim 1, wherein said gaseous fuel is injected into said combustion chamber with a carrier fluid.

4. A process in accordance with claim 3, wherein said carrier fluid is an inert gas.

5. A process in accordance with claim 3, wherein said carrier fluid is selected from the group consisting of steam, recirculated flue gas, and mixtures thereof.

6. A process in accordance with claim 3, wherein said carrier fluid is injected into said combustion chamber at a mass flow rate in a range of about 0 to 5 times a mass flow rate of said gaseous fuel injected into said combustion chamber.

7. A process in accordance with claim 6, wherein said carrier fluid is injected into said combustion chamber at a mass flow rate in a range of about 1 to 2 times the mass flow rate of said gaseous fuel injected into said combustion chamber.

8. A process in accordance with claim 3, wherein said carrier fluid is premixed with said gaseous fuel prior to injection into said combustion chamber.

9. A process in accordance with claim 1, wherein said gaseous fuel is injected into said combustion chamber at a rate which results in an oxygen content of flue gases exiting said combustion chamber in a range of about 0.5% to 5.0%.

10. A process in accordance with claim 1, wherein said gaseous fuel is injected into said combustion chamber at a rate which results in an oxygen content of flue gases exiting said combustion chamber in a range of about 1.0 to 2.0 percent and a CO content of less than about 200 ppm.

11. A process in accordance with claim 1, wherein said gaseous fuel injected into said combustion chamber comprises is in a range of about 2 to 15 percent of a total amount of heat input to said combustion chamber.

12. A process in accordance with claim 1, wherein a primary air/fuel stoichiometric ratio in said primary combustion zone is in a range of about 1.05 to 1.30.

13. A process in accordance with claim 1, wherein a secondary air/fuel stoichiometric ratio in said secondary combustion zone is in a range of about 1.05 to 1.20.

14. A process in accordance with claim 13, wherein said secondary air/fuel stoichiometric ratio is in the range of about 1.05 to about 1.10.

15. A process in accordance with claim 1, wherein said solid carbonaceous material is at least one of crushed coal and pulverized coal.

* * * * *